US008394567B2

(12) United States Patent
Kamiwaki et al.

(10) Patent No.: US 8,394,567 B2
(45) Date of Patent: Mar. 12, 2013

(54) TONER, DEVELOPER, TONER CARTRIDGE, PROCESS CARTRIDGE, AND IMAGE FORMING APPARATUS

(75) Inventors: Satoshi Kamiwaki, Kanagawa (JP); Akira Matsumoto, Kanagawa (JP); Sakon Takahashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 302 days.

(21) Appl. No.: 12/726,004

(22) Filed: Mar. 17, 2010

(65) Prior Publication Data

US 2011/0076606 A1 Mar. 31, 2011

(30) Foreign Application Priority Data

Sep. 25, 2009 (JP) ..... 2009-221030

(51) Int. Cl.
*G03G 9/09* (2006.01)

(52) U.S. Cl. ..... 430/108.9; 430/108.1; 430/108.2; 430/108.8; 399/222

(58) Field of Classification Search ..... 430/108.1, 430/108.2, 108.8, 108.9; 399/222
See application file for complete search history.

(56) References Cited

U.S. PATENT DOCUMENTS

| | | | | |
|---|---|---|---|---|
| 4,910,113 | A | 3/1990 | Mori et al. | |
| 4,983,681 | A | 1/1991 | Mori et al. | |
| 5,714,292 | A * | 2/1998 | Anno et al. | 430/108.1 |
| 5,759,728 | A * | 6/1998 | Hagi et al. | 430/107.1 |
| 2008/0176159 | A1 * | 7/2008 | Matsumoto et al. | 430/109.4 |
| 2009/0035679 | A1 * | 2/2009 | Ogawa et al. | 430/106.2 |

FOREIGN PATENT DOCUMENTS

| | | |
|---|---|---|
| JP | A-5-241378 | 9/1993 |
| JP | 2001-305803 | * 11/2001 |
| JP | A-2007-279596 | 10/2007 |

OTHER PUBLICATIONS

Translation of JP 2001-305803 published Nov. 2001.*

* cited by examiner

*Primary Examiner* — Peter Vajda
(74) *Attorney, Agent, or Firm* — Oliff & Berridge, PLC

(57) ABSTRACT

There is provided a toner for electrostatic latent image developing, which includes a binder resin; a carbon black-surface treated with an isocyanate compound including a plurality of isocyanate groups which include one or more isocyanate groups that are not bonded to the carbon black; and a release agent having an acid value of about 5 mgKOH/g or higher and/or a hydroxyl value of about 5 mgKOH/g or higher.

13 Claims, 2 Drawing Sheets

TONER, DEVELOPER, TONER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2009-221030 filed on Sep. 25, 2009.

BACKGROUND

1. Technical Field

The present invention relates to a toner, a developer, a toner cartridge, a process cartridge, and an image forming apparatus.

2. Related Art

In general, electrophotographic image forming apparatuses are configured to perform uniform charging of the surface of an electrostatic latent image holding member (a charging process), exposing of the surface of the electrostatic latent image holding member to light to form an electrostatic latent image (an exposing process), developing of the latent image on the surface of the electrostatic latent image holding member using a developer layer formed on the surface of a developer holding member to obtain a toner image (a developing process), transferring of the toner image to a transfer material (a transfer process), fixing of the toner image on the transfer material (a fixing process), and removing of toner remaining on the surface of the electrostatic latent image holding member in the transfer process (a cleaning process).

SUMMARY

According to an aspect of the present invention, a toner including a binder resin, carbon black whose surface is treated with an isocyanate compound including a plurality of isocyanate groups, a part of the plurality of isocyanate groups being unbonded, and a release agent having an acid value of about 5 mgKOH/g or higher and/or a hydroxyl value of about 5 mgKOH/g or higher, is provided.

BRIEF DESCRIPTION OF THE DRAWINGS

Exemplary embodiments of the present invention are described in detail based on the following figures, wherein.

DETAILED DESCRIPTION

Toner for Electrostatic Charge Image Development

Figure 1:
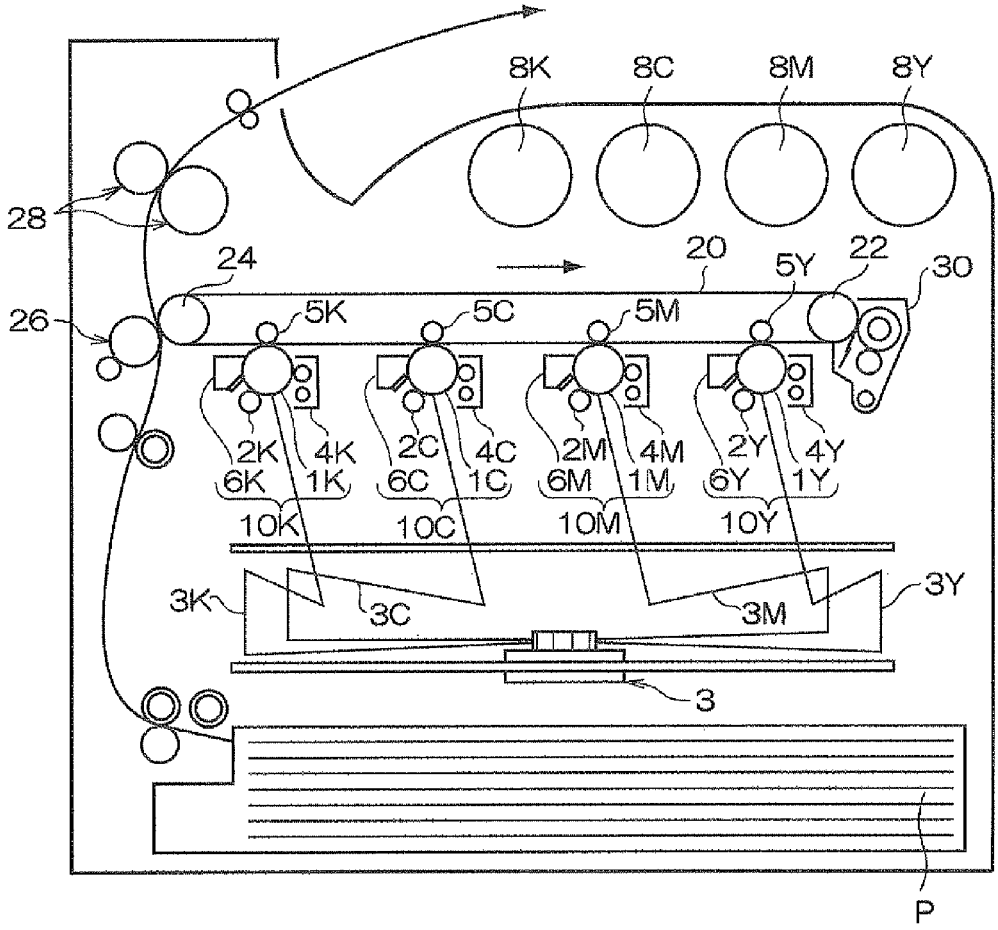
FIG. 1 is a schematic configuration diagram showing an example of an image forming apparatus according to the present exemplary embodiment.

The toner for electrostatic charge image development (hereinafter sometimes referred to as a "toner") according to the exemplary embodiment contains a binder resin, carbon black whose surface is treated with an isocyanate compound including two or more isocyanate groups, a part of the plurality of isocyanate groups being unbonded; and a release agent having an acid value of 5 mgKOH/g (or about 5 mgKOH/g) or higher and/or a hydroxyl value of 5 mgKOH/g (or about 5 mgKOH/g) or higher (hereinafter sometimes referred to as a "release agent").

The carbon black whose surface is treated with the compound including two or more isocyanate groups (hereinafter sometimes referred to as "a polyvalent isocyanate compound") is sometimes referred to as a "treated carbon black".

By using in combination the treated carbon black and a specific release agent having an acid value and/or a hydroxyl value of 5 mgKOH/g (or about 5 mgKOH/g) or higher, according to the exemplary embodiment, it is possible to obtain a toner in which aggregation is unlikely to occur and the occurrence of a color point is suppressed.

Here, the "aggregation" refers to phenomenon in which particles of the toner are formed into a lump during storage or in a developing device.

The toner according to the exemplary embodiment contains toner particles containing the binder resin, the treated carbon black, and the release agent and may further contain one or more additional ingredients, such as external additives. Accordingly, the toner particles contain the three components mentioned above and may further contain other components.

In the treated carbon black in the toner according to the exemplary embodiment, it is thought that at least one isocyanate group of the polyvalent isocyanate compound is bonded to a functional group (e.g., an OH group, a —COOH group, or ═C═O) on the surface of the carbon black and that at least one isocyanate group which is not bonded to the carbon black is present in the polyvalent isocyanate compound that is bonded to and present around the carbon black.

The reason why aggregation is unlikely to occur according to the toner of the exemplary embodiment, in which the carbon black having on the surface at least one isocyanate group of the polyvalent isocyanate compound, and the specific release agent in which at least either one of the acid value or the hydroxyl value is 5 mgKOH/g or higher are used, is thought as follows.

When an isocyanate group that is not bonded to the carbon black is present on the surface of the particles of the carbon black, a structure in which the isocyanate group that is not bonded to the carbon black enters the release agent may easily be formed, and thus the compatibility with the release agent and the carbon black may be strengthened.

When the release agent has a functional group that interacts with the isocyanate group described later, the interaction between the functional group of the release agent and the treated carbon black may be further strengthened.

As a result, the crystal growth of the release agent can be suppressed.

When the crystal growth of the release agent is suppressed, protrusion (hereinafter sometimes referred to as "projection") of the release agent to the surface of the toner particles may be suppressed. As a result of suppressing the protrusion of the release agent, the exposure of the release agent at the surface of the toner particles may be suppressed. Thus, the aggregation of the toner particles may be suppressed.

When the external additive is added, the exposure of the release agent at the surface of the toner particles is suppressed similarly as in the above described case where the external additive is not added. Thus, the external additive may be easily attached with less unevenness, and that the toner may be unlikely to aggregate. Moreover, the powder properties (e.g., fluidity and uniformity of the toner) of the toner may be improved.

Hereinafter, each component of the toner according to the exemplary embodiment is described.

First, the toner particles is described.

A carbon black to be used for the treated carbon black is not limited insofar as the carbon black has a functional group that can be bonded to an isocyanate group on the surface of the carbon black. Examples the carbon black include channel black, furnace black, acetylene black, and thermal black. As the carbon black, a carbon black having a dibutyl phthalate (DBP) absorption amount of 50 ml/100 g (or about 50 ml/100 g) or higher and 250 ml/100 g (or about 250 ml/100 g) or lower is preferable in terms of excellent production stability. The DBP (dibutyl phthalate) absorption amount is defined in ASTM D2414-6TT, the disclosure of which is incorporated by reference herein, and indicates the amount of DBP (ml) absorbed by 100 g of carbon black.

Examples of the polyvalent isocyanate compound include diisocyanate compounds and triisocyanate compounds. Among the above, the triisocyanate compounds are preferable because interaction with a release agent may be strengthened when one isocyanate group is bonded to a carbon black and two unbonded isocyanate groups are contained. Specific examples of the polyvalent isocyanate compound include diisocyanates and triisocyanates, such as 2,4-tolylene diisocyanate, 2,6-tolylene diisocyanate, diphenyl methane diisocyanate, polymeric diphenylmethane diisocyanate, hydrogenated diphenylmethane diisocyanate, 1,5-naphthalene diisocyanate, 3,3'-dimethyldiphenyl-4,4'-diisocyanate, hexamethylene diisocyanate, isophorone diisocyanate, m-phenylene diisocyanate, p-phenylene diisocyanate, trans cyclohexane 1,4-diisocyanate, diphenyl ether diisocyanate, xylylene diisocyanate, hydrogenated xylylene diisocyanate, 2,6-diisocyanatocaproic acid, tetramethyl-m-xylene diisocyanate, tetramethyl-p-xylene diisocyanate, trimethylhexamethylene diisocyanate, triphenylmethane triisocyanate, tris (isocyanatophenyl)thiophosphate, isocyanatoalkyl-2,6-diisocyanato capronate, 1,6,11-undecane triisocyanate, 1,8-diisocyanato-4-isocyanatomethyloctane, 1,3,6-hexamethylene triisocyanate, bicycloheptane triisocyanate, m-phenylene diisocyanate, p-phenylene diisocyanate, 2,6-tolylene diisocyanate, 2,4-tolylene diisocyanate, naphthalene-1,4-diisocyanate, diphenyl methane-4,4-diisocyanate, 3,3'-dimethoxy-4,4-biphenyl diisocyanate, 3,3'-dimethylphenylmethane-4,4'-diisocyanate, xylylene-1,4-diisocyanate, 4,4'-diphenylpropanediisocyanate, trimethylenediisocyanate, hexamethylenediisocyanate, propylene-1,2-diisocyanate, butylene-1,2-diisocyanate, cyclohexylene-1,2-diisocyanate, cyclohexylene-1,4-diisocyanate, 4,4',4"-triphenylmethanetriisocyanate, or toluene-2,4,6-triisocyanate.

Example of a method for obtaining a polyvalent isocyanate compound in which at least one isocyanate group of the polyvalent isocyanate compound is bonded to a carbon black and at least one isocyanate group is not bonded to the carbon black include a method in which reacting an excessive amount of the polyvalent isocyanate compound is reacted to the carbon black beforehand. In this method, the carbon black treated with the polyvalent isocyanate compound is used for the production of toner particles after the remainder of the polyvalent isocyanate compound is removed.

Examples of the treatment of the carbon black using the polyvalent isocyanate compound include a method in which the carbon black and the polyvalent isocyanate compound is added to a solvent, and stirring the resultant mixture. Examples of the solvent for use in the reaction include ethyl acetate, acetone, and methyl ethyl ketone. The temperature in this case is not particularly limited, and is preferably from 25° C. to 150° C. and more preferably from 40° C. to 90° C. in terms of reaction control.

From the viewpoint of controlling the charging properties of the toner having black tinting strength, the content of the carbon black in a toner is preferably from 0.1% by weight (or about 0.1% by weight) to 20% by weight (or about 20% by weight) and more preferably from 0.5% by weight to 10% by weight.

Examples of the binder resin include known binder resins. Examples include homopolymers or copolymers of styrene, monoolefin, vinyl acetate, vinyl propionate, vinyl ester, methylene aliphatic monocarboxylic acid ester, vinyl ethers, such as vinyl methyl ether, vinyl ethyl ether, or vinyl butyl ether, vinyl ketone, such as vinyl methyl ketone, vinyl hexyl ketone, or vinyl isopropenyl ketone.

Specific examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic acid anhydride copolymer, polyethylene, and polypropylene. Examples of the binder resin further include polyester, polyurethane, epoxy resin, silicone resin, polyamide, and modified rosin. Among the above, it is preferable to use polyester as the binder resin.

When the resin has a polar group, it is possible to bond the resin to the isocyanate group present in the treated carbon black due to the polarity. Examples of the polar group include a carboxyl group, an ester group, and a hydroxyl group which is used to form a urethane bond (e.g., alcoholic and phenolic hydroxyl groups).

The content of the binder resin in a toner is preferably from 40% by weight to 98% by weight and more preferably from 50% by weight to 96% by weight from the viewpoint of securing the strength of fixed images.

The toner according to the exemplary embodiment contains at least a release agent having an acid value of 5 mgKOH/g or higher and/or a hydroxyl value of 5 mgKOH/g or higher.

The release agent may be any release agent having an acid value of 5 mgKOH/g or higher and/or a hydroxyl value of 5 mgKOH/g or higher. It is more preferable to satisfy the acid value than to satisfy the hydroxyl value in terms of effect of suppressing aggregation.

The measurement of the acid value and the hydroxyl value in the exemplary embodiment is performed by the following methods.

For the acid value and the hydroxyl value, values measured according to the method (potentiometric titration method) prescribed in JIS K0070-1992, the disclosure of which is incorporated herein, are used. However, when a sample does not dissolve, a solvent, such as dioxane or THF, is used for a solvent.

When the acid value is smaller than 5 mgKOH/g, the compatibility with the treated carbon black deteriorates and aggregation may be likely to occur. When the acid value is 5 mgKOH/g or higher, aggregation is unlikely to occur. As the acid value becomes higher, the release agent becomes more favorable. From the viewpoint of the working efficiency and hygroscopicity, the acid value is preferably from 5 mgKOH/g to 100 mgKOH/g.

When the hydroxyl value is smaller than 5 mgKOH/g, the compatibility with the treated carbon black deteriorates, and aggregation may be likely to occur. When the hydroxyl value is 5 mgKOH/g or higher, aggregation is unlikely to occur. The higher the hydroxyl value, the better. From the viewpoint of the working efficiency and hygroscopicity, the hydroxyl value is preferably from 5 mgKOH/g to 100 mgKOH/g.

The combination of the acid value and the hydroxyl value of the release agent is preferably from 5 mgKOH/g to 100 mgKOH/g and from 5 mgKOH/g to 100 mgKOH/g, more preferably from 7 mgKOH/g to 90 mgKOH/g and from 10 mgKOH/g to 90 mgKOH/g, and still more preferably from 10 mgKOH/g to 80 mgKOH/g and from 15 mgKOH/g to 80 mgKOH/g, respectively, in terms of compatibility with the treated carbon black and hygroscopicity.

Any release agent may be used without particular limitation insofar as the release agent satisfies at least either one of the acid value or the hydroxyl value.

Examples of the release agent include waxes, such as polyolefins, waxes, such as paraffins, silicones, fatty acid amides, such as oleic acid amide, erucic acid amide, ricinoleic acid amide, or stearic acid amid; vegetable waxes, such as carnauba wax, rice wax, candelilla wax, Japan wax, or jojoba oil; animal waxes, such as yellow bees wax; mineral•petroleum waxes, such as Montan wax, ozokerite, ceresin, or Fischer-Tropsch wax; and ester waxes, such as fatty acid ester, montanoic acid ester, or carboxylic acid ester.

Among the above, preferable specific examples include alcohol-modified Fischer-Tropsch wax in which Fischer-Tropsch wax is converted to alcohol (the acid value of 43 and the hydroxyl value of 38) and ester wax (the acid value of 13 and the hydroxyl value of 20).

A series of processes for generating hydrocarbon waxes having a hydroxyl group from aliphatic hydrocarbon waxes are referred to as alcohol conversion. Examples of the alcohol conversion include various processes. Examples include a method including generating a borate ester of the hydrocarbon wax from hydrocarbon waxes, and hydrolyzing the borate ester of the hydrocarbon wax to generate a hydrocarbon wax having a hydroxyl group. It is preferable to obtain the hydrocarbon wax having desired properties using the process of the alcohol conversion in terms of easily controlling degree of conversion of the acid group, hydroxyl group, and ester group of the hydrocarbon wax.

Examples of a method for producing the hydrocarbon wax having a hydroxyl group from aliphatic hydrocarbon waxes include a method for producing the same by subjecting the hydrocarbon waxes to liquid-phase oxidation with a molecular oxygen-containing gas in the presence of boric acid and boric acid anhydride. As a catalyst, a mixture of boric acid and boric acid anhydride can be used. The mixing ratio of the boric acid and the boric acid anhydride (boric acid/boric acid anhydride) may be in the range of from 1.0 to 2.0 and preferably from 1.2 to 1.7, in molar ratio. When the proportion of the boric acid anhydride is lower than the above range, excess boric acid may cause an aggregation phenomenon. When the proportion of the boric acid anhydride is higher than the above range, a powder substance originating from the boric acid anhydride may be collected after the reaction and excess boric acid anhydride does not participate in the reaction, thus the proportion in the above range is preferable from an economical standpoint as well.

The addition amount of the boric acid and the boric acid anhydride to be used is preferably from 0.001 mol to 10 mol and particularly preferably from 0.1 mol to 1.0 mol, per 1 mole of the raw-material aliphatic hydrocarbon when the mixture thereof is converted in terms of the amount of the boric acid.

As the molecular oxygen-containing gas to be charged in a reaction system, any one of various gases, such as oxygen, air, or gases obtained by diluting the same with inert gas, can be. The oxygen concentration is preferably from 1 to 30% by volume and more preferably from 3 to 20% by volume.

The liquid-phase oxidation reaction is generally carried out without the use of any solvent, in a state in which the raw-material aliphatic hydrocarbon is molten. The reaction temperature is from 120° C. to 280° C. and preferably from 150° C. to 250° C. The reaction time is preferably from 1 hour to 15 hours. The boric acid and the boric acid anhydride are preferably are preferably mixed in advance and then added to the reaction system. When the boric acid only is added alone, dehydration reaction or the like of the boric acid may occur. A mixed catalyst of the boric acid and the boric acid anhydride may be added at a temperature of from 100° C. to 180° C. and preferably from 110° C. to 160° C. When the temperature is lower than 100° C., the catalytic activity of the boric acid anhydride may decrease due to the moisture or the like remaining in the system.

After the completion of the reaction, water is added to the reaction mixture, a borate ester of the wax formed is hydrolyzed, and then purified, thereby obtaining a desired wax.

The release agent may have at least one functional group that interacts with the isocyanate group of the treated carbon black.

Examples of the interaction include, from the viewpoint of easily forming a structure in which the release agent enters the carbon black, a covalent bond, and an ionic bond, a hydrogen bond, polar interaction, and Van der Waals interaction in which a strong bond may be formed without application of energy, such as applying heat.

The interacting functional group is not particularly limited insofar as the functional group interacts with the isocyanate group, and examples thereof include known functional groups. Specific examples include a carboxyl group, an ester group, a hydroxyl group, and a ketone group from the viewpoint of strengthening the interaction between the treated carbon black and the release agent, and preferable examples include a carboxyl group and a hydroxyl group. For example, when the release agent has a carboxyl group as the interacting functional group, the carboxyl group and the isocyanate group of the treated carbon black electrically interacts with each other. Therefore, even when the action of energy from the outside, such as heat or light, is applied, an effect whereby the entanblement is not easily released may be exhibited. Such effect may maintained over a long period of time.

One kind of release agent may be used singly or two or more kinds of the release agents may be used in combination.

As the amount of the release agent to be used, the release agent is contained in a toner in an amount of preferably from 2% by weight (or about 2% by weight) to 20% by weight (or about 20% by weight) and more preferably from 4% by weight to 12% by weight. When the amount of the release agent exceeds 2% by weight, offset is unlikely to occur and when the amount is 20% by weight or lower, the powder flowability of the toner may improve.

The toner particles in this exemplary embodiment may further include a known charge control agent, examples of such charge control agent include azo metal complex compounds, metal complex compounds of salicylic acid, and resin type charge control agents containing a polar group.

A method for producing the toner particles in the exemplary embodiment is not particularly limited. A wet process is preferable because the process allows the presence of a unbonded isocyanate group on the surface of toner particles. Examples of the wet process include a melt-suspension method, an emulsion-aggregation method, and a dissolving-suspension method, and, among the above, the emulsion-aggregation method is preferable.

The emulsion-aggregation method is a method including individually preparing dispersion liquids (pigment dispersion liquid, emulsified liquid, etc.) containing components (the treated carbon black, binder resin, release agent, etc.) to be contained in the toner particles, mixing the dispersion liquids so as to aggregate coloring particle components to form aggregated particles, and heating the aggregated particles to a temperature equal to or higher than the melting point or the glass transition temperature of the binder resin, thereby thermally coalescing the aggregated particles.

To the toner according to the exemplary embodiment, external additives may be externally applied.

When the toner particles are produced using the treated carbon black and a specific release agent, the projection of the release agent to the surface of the toner particles is suppressed. As a result of suppressing the projection, the exposure of the release agent to the surface of the toner particles is suppressed. Thus, it is considered that the aggregation of the toner particles is suppressed.

When the external additive is added, the exposure of the release agent at the surface of the toner particles may be suppressed similarly as in the case where the external additive is not added. Therefore, it is thought that the external additive is likely to adhere without variation, and thus the tone particles are unlikely to aggregate. Moreover, the powder properties (e.g., the flowability and uniformity of the toner) of the toner may be improved.

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surface of the external additives may be subjected to hydrophobic treatment beforehand. The hydrophobic treatment improves the powder flowability of the toner, and also is effective for the environment dependence of charging and carrier contamination resistance. The hydrophobic treatment is performed by, for example, immersing inorganic particles in a hydrophobic treatment agent. The hydrophobic treatment is not particularly limited, examples include a silane coupling agent, a silicone oil, a titanate coupling agent, and an aluminum coupling agent. These agents may be used singly or in combination of two or more kinds thereof.

The external additive may be added to the toner particles by mixing the toner particles and the external additive by a known method, such as a V blender, a HENSCHEL mixer, or a Loedige mixer.

The proportion of the external additives based on 100 parts by weight of the toner particles in the toner according to the exemplary embodiment is, for example, from 0.5 part by weight to 2.5 parts by weight.

Developer for Electrostatic Charge Image Development

The developer for electrostatic charge image development (hereinafter sometimes referred to as a "developer") according to the exemplary embodiment contains the toner according to the exemplary embodiment described above.

The toner according to the exemplary embodiment may be used as a one-component developer as it is or may be used in a two-component developer. When used in the two-component developer, the toner is mixed with a carrier.

The carrier usable in the two-component developer is not particularly limited, and any known carrier may be used. Examples of the carrier include magnetic metals, such as nickel or cobalt, magnetic oxides, such as ferrite or magnetite, a resin-coated carrier having a resin-coated layer on the surface of the core material thereof, and a magnetic dispersion type carrier. Examples of the carrier further include a resin dispersion type carrier in which a conductive material or the like is dispersed in a matrix resin.

Examples of the coated resin and matrix resin to be used in the carrier include, but not limited thereto, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene acrylic acid copolymer, a straight silicone resin containing an organosiloxane bond or a modified article thereof, a fluoro resin, polyester, polycarbonate, a phenol resin, and an epoxy resin.

Examples of the conductive material include, but not limited thereto, metals, such as gold, silver, or copper, carbon black, titanium oxide, zinc oxide, barium sulfate, aluminum borate, potassium titanate, tin oxide, and carbon black.

Examples of the core material of the carrier include magnetic metals, such as iron, nickel, or cobalt, magnetic oxides, such as ferrite or magnetite, and glass beads. In order to use the carrier for a magnetic brush method, the carrier is preferably a magnetic material. The volume average particle size of the core material of the carrier is generally in the range of from 10 μm to 500 μm.

The mixing ratio (toner:carrier, weight ratio) of the toner for electrostatic charge image development and the carrier according to the exemplary embodiment in the two-component developer is, for example, from 1:100 to 30:100.

Image Forming Apparatus

An image forming apparatus according to the exemplary embodiment includes: an electrostatic latent image holding member; a charging unit that charges the surface of the electrostatic latent image holding member; an electrostatic latent image forming unit that forms an electrostatic latent image on the surface of the electrostatic latent image holding member; a developing unit that develops the electrostatic latent image with the developer for electrostatic charge image development according to the exemplary embodiment described above; a transfer unit that transfers the toner image to a recording medium; and a fixing unit that fixes the toner image to the recording medium. Due to the use of the developer for electrostatic charge image development containing the toner for electrostatic charge image development according to the exemplary embodiment previously described above, the aggregation of the toner may be suppressed, and images in which image defects associated with the flowability of the toner are suppressed may be obtained.

Hereinafter, an example of the image forming apparatus according to the exemplary embodiment is described, but the exemplary embodiment is not limited thereto. The essential portions shown in the drawings are described and the description of other portions is omitted.

FIG. 1 is a schematic configuration diagram showing a four-tandem color image forming apparatus. The image forming apparatus shown in FIG. 1 has first to fourth electrophotographic image forming units 10Y, 10M, 10C, and 10K (image forming unit) that output images of colors of yellow (Y), magenta (M), cyan (C), and black (K) respectively based on color-separated image data. These image forming units (hereinafter sometimes simply referred to as a "unit") 10Y, 10M, 10C, and 10K are disposed at a predetermined distance in the horizontal direction. These units 10Y, 10M, 10C, and 10K may be process cartridges that are removably attached to the body of the image forming apparatus.

Above the units of 10Y, 10M, 10C, and 10K, an intermediate transfer belt 20 as an intermediate transfer medium is disposed so as to extend through the respective units of 10Y, 10M, 10C, and 10K (in FIG. 1) the units. The intermediate transfer belt 20 is wound around a driving roller 22 and a support roller 24, which are disposed apart from each other in the longitudinal direction of FIG. 1 and contact the inner surface of the intermediate transfer belt 20, in such a manner as to move in the direction from the first unit 10Y to the fourth unit 10K. To the support roller 24, force is applied by a spring or the like (not shown) in the direction separating from the driving roller 22, and tension is applied to the intermediate transfer belt 20 wound around both the rollers. To the image holding member side of the intermediate transfer belt 20, an intermediate transfer medium cleaning device 30 is disposed so as to face the driving roller 22.

To development devices (developing units) 4Y, 4M, 4C, and 4K of the corresponding units 10Y, 10M, 10C, and 10K, toners of four colors of yellow, magenta, cyan, and black stored in the corresponding toner cartridges 8Y, 8M, 8C, and 8K are supplied, respectively.

The first to fourth units 10Y, 10M, 10C, and 10K described above have the same structure. Therefore, here, the first unit 10Y forming yellow images that is disposed at the upper stream side of the travel direction of the intermediate transfer belt is described as a typical example. The description of the second to fourth units 10M, 10C, and 10K is omitted by designating the portions equivalent to those of the first unit 10Y with magenta (M), cyan (C), and black (K) in place of yellow (Y).

The first unit 10Y has a photoreceptor 1Y that acts as the electrostatic latent image holding member. Around the photoreceptor 1Y, a charging roller (charging unit) 2Y that charges the surface of the photoreceptor 1Y to a predetermined potential, an exposure device (electrostatic latent image forming unit) 3 that exposes the charged surface with a laser beam 3Y based on a color-separated image signal to form an electrostatic charge image, a developing device (developing unit) 4Y that supplies a charged toner to the electrostatic latent image to develop the electrostatic latent image, a primary transfer roller 5Y (primary transfer unit) that transfers the developed toner image onto the intermediate transfer belt 20, and a photoreceptor cleaning device (cleaning unit) 6Y that removes the toner remaining on the surface of the photoreceptor 1Y after the primary transfer, are disposed in order.

The primary transfer roller 5Y is disposed inside the intermediate transfer belt 20, and is disposed at the position facing the photoreceptor 1Y. Furthermore, a bias power supply (not shown) that applies a primary transfer bias is connected to each of primary transfer rollers 5Y, 5M, 5C, and 5K. Each bias power supply varies the transfer bias applied to the primary transfer roller by the control of a control unit (not shown).

Hereinafter, operation for forming a yellow image in the first unit 10Y is described. First, prior to the operation, the surface of the photoreceptor 1Y is charged by the charging roller 2Y to a potential of about −600 V to about −800 V.

The photoreceptor 1Y includes a photosensitive layer disposed on a conductive (volume resistivity at 20° C.: $1\times10^{-6}$ Ωcm or lower) substrate. The photosensitive layer usually has a high resistance (resistance same or similar to that of general resins). When the photosensitive layer is irradiated with the laser beam 3Y, the specific resistance of the laser beam-irradiated portions changes. Then, the laser beam 3Y is emitted to the surface of the charged photoreceptor 1Y through the exposure device 3 according to yellow image data transmitted from a control unit (not shown). The laser beam 3Y is emitted to the photosensitive layer on the surface of the photoreceptor 1Y, and thus an electrostatic charge image having a yellow printing pattern is formed on the surface of the photoreceptor 1Y.

The electrostatic charge image is an image formed on the surface of the photoreceptor 1Y by charging, and is a so-called negative latent image that is formed when the specific resistance of the irradiated portion of the photosensitive layer is reduced by the laser beam 3Y and the charged charges on the surface of the photoreceptor 1Y flow, and, in contrast, when the charges in a portion not irradiated with the laser beam 3Y remain.

The electrostatic charge image thus formed on the photoreceptor 1Y is rotated to the predetermined development position according to the movement of the photoreceptor 1Y. Then, the electrostatic charge image on the photoreceptor 1Y is formed into a visible image (developed image) by the development device 4Y at the development position.

In the development device 4Y, a developer containing at least a yellow toner is contained, for example. The yellow toner is stirred in the development device 4Y, thereby frictionally charging the toner, and is held on a developer roll (developer holding member) while having the same polarity (negative polarity) as that of the charges on the photoreceptor 1Y. When the surface of the photoreceptor 1Y passes through the development device 4Y, the yellow toner electrostatically adheres to a charge-erased latent image portion on the surface of the photoreceptor 1Y, and thus the latent image is developed by the yellow toner. The photoreceptor 1Y on which the yellow toner image is formed successively moves at a predetermined rate, and the toner image developed on the photoreceptor 1Y is conveyed to a primary transfer position.

When the yellow toner image on the photoreceptor 1Y is conveyed to the primary transfer position, a primary transfer bias is applied to the primary transfer roller 5Y, static electricity force directing to the primary transfer roller 5Y from the photoreceptor 1Y acts on the toner image, and then the toner image on the photoreceptor 1Y is transferred to the intermediate transfer belt 20. The transfer bias applied at this time has a (+) polarity reverse to the polarity (−) of the toner, and is controlled to, for example, about +10 μA by a control unit (not shown) in the first unit 10Y.

The toner remaining on the photoreceptor 1Y is removed and collected by the cleaning device 6Y.

The primary transfer bias applied to the primary transfer rollers 5M, 5C, and 5K subsequent to the second unit 10M is also controlled in accordance with the first unit.

Thus, the intermediate transfer belt 20 to which the yellow toner image is transferred by the first unit 10Y is successively conveyed through the second to fourth units 10M, 10C, and 10K, toner images of the respective colors are disposed thereon, and multi-transfer is achieved.

In the image forming apparatus shown in FIG. 1, the developer for electrostatic charge image development according to the exemplary embodiment is used in the fourth unit 10K, and thus the aggregation of the toner may be suppressed, whereby images in which image defects associated with the flowability of the toner are suppressed may be obtained.

The intermediate transfer belt 20 to which the toner images of four colors are multi-transferred through the first to fourth units reaches a secondary transfer portion formed by the intermediate transfer belt 20, the support roller 24 contacting the inner surface of the intermediate transfer belt, and a secondary transfer roller (secondary transfer unit) 26 disposed at the image holding surface side of the intermediate transfer belt 20. A recording paper (transfer material) P is supplied through a supply mechanism at a predetermined timing to a portion where the secondary transfer roller 26 and the intermediate transfer belt 20 are pressed against each other, and the secondary transfer bias is applied to the support roller 24. The transfer bias applied at this time has the same (−) polarity as the polarity (−) of the toner, static electricity force directing to the recording form P from the intermediate transfer belt 20 acts on the toner image, and thus the toner image on the intermediate transfer belt 20 is transferred to the recording paper P. The secondary transfer bias in this case is determined according to the resistance detected by a resistance detection unit (not shown) that detects the resistance of the secondary transfer portion, and voltage control is carried out.

Thereafter, the recording paper P is conveyed to a pressurized portion (nip portion) of a pair of fixing rolls in a fixing device (roll-shaped fixing unit) 28, the toner image is heated, and the multi-colored toner image is melted and fixed onto the recording paper P.

Examples of the transfer material to which the toner image is transferred include a regular paper for use in electrophotographic copying machines, printers, or the like and an OHP sheet.

After the completion of the fixing of the color image on the recording paper P, the recording paper P is discharged to a discharging portion, and a series of color image forming operation are completed.

In the image forming apparatus described above as an example, the toner image is transferred to the recording paper P through the intermediate transfer belt 20. However, the structure of the image forming apparatus is not limited thereto, and the toner image may be directly transferred to the recording paper from the photoreceptor.

Process Cartridge and Toner Cartridge

The process cartridge according to the exemplary embodiment includes a developing unit that develops an electrostatic latent image with the developer for electrostatic charge image development according to the exemplary embodiment as described above to form a toner image, and at least one selected from the group consisting of an electrostatic latent image holding member, a charging unit that charges the surface of the electrostatic latent image holding member, and a cleaning unit that remove a toner remaining on the surface of the electrostatic latent image holding member.

Figure 2:
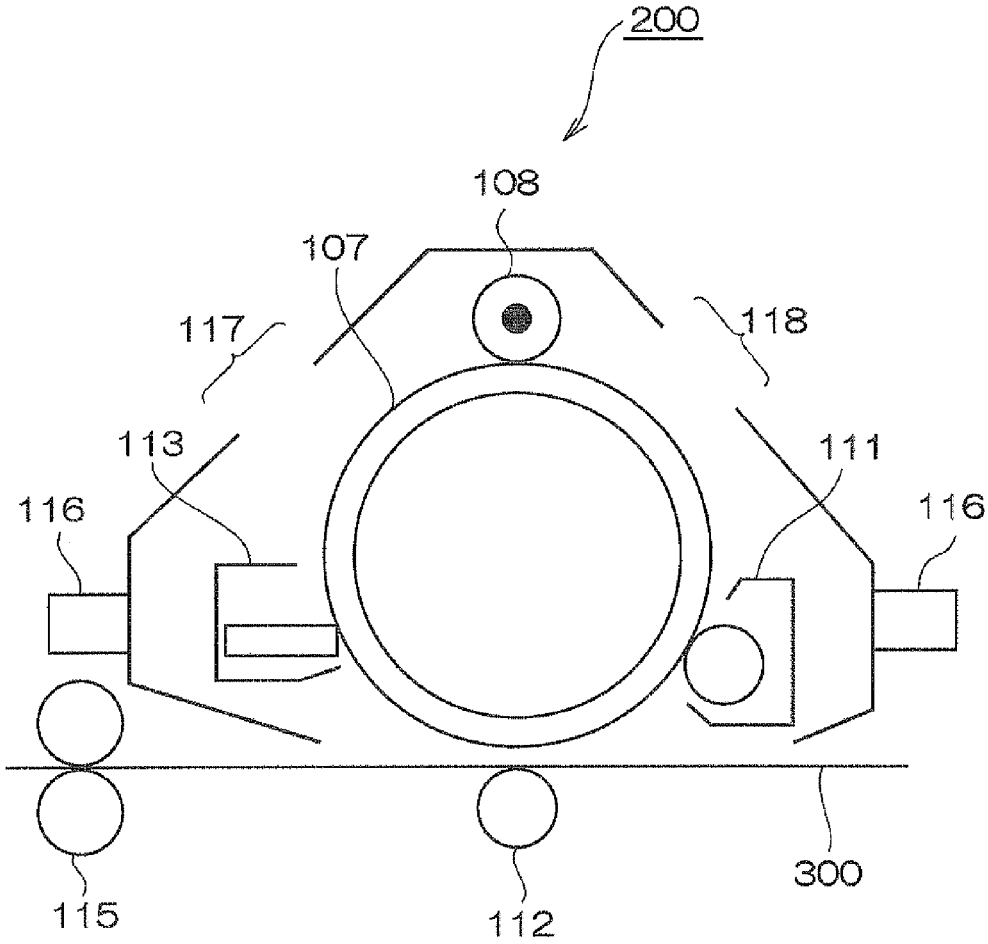
FIG. 2 is a schematic configuration diagram showing an example of a process cartridge according to the present exemplary embodiment.

FIG. 2 is a schematic configuration diagram showing an exemplary embodiment of an example of the process cartridge according to the exemplary embodiment. A process cartridge 200 includes a photoreceptor 107, a charging roller 108, a development device 111, a photoreceptor cleaning device 113, an opening 118 for exposure, and an opening 117 for exposure for erasing charges, which are combined and integrated using a rail 116. In FIG. 2, the reference number 300 designates a transfer material.

The process cartridge 200 is detachable to an image forming apparatus including a transfer device 112, a fixing device 115, and additional component(s) (not shown), and is served as a component of the image forming apparatus together with the main body of the image forming apparatus.

The process cartridge 200 shown in FIG. 2 includes the charging device 108, the development device 111, the photoreceptor cleaning device 113, the opening 118 for exposure, and the opening 117 for exposure for erasing charges, but the devices may be selectively combined. The process cartridge according to the exemplary embodiment includes the photoreceptor 107, and at least one selected from the group consisting of the charging device 108, the development device 111, the photoreceptor cleaning device (cleaning unit) 113, the opening 118 for exposure, and the opening 117 for exposure for erasing charges.

Next, the toner cartridge according to the exemplary embodiment is described. The toner cartridge according to the exemplary embodiment contains at least the toner according to the exemplary embodiment described above. To the toner cartridge according to the exemplary embodiment, at least the toner according to the exemplary embodiment may be held, and therefore, the toner cartridge according to the exemplary embodiment may contain, for example, a developer, depending on the mechanism of the image forming apparatus.

Therefore, in the image forming apparatus having a structure in which the toner cartridge is detachably provided, the toner for electrostatic charge image development according to the exemplary embodiment is easily supplied to the development device by utilizing the toner cartridge containing the toner for electrostatic charge image development according to the exemplary embodiment.

The image forming apparatus shown in FIG. 1 is an image forming apparatus having a structure in which the toner cartridges 8Y, 8M, 8C, and 8K are detachably provided. The development devices 4Y, 4M, 4C, and 4K are connected to toner cartridges corresponding to the respective development devices for respective colors by a toner supply pipe (not shown). When the amount of the toner stored in the toner cartridge becomes small, the toner cartridge is exchanged.

EXAMPLES

Hereinafter, the present invention is described with reference to Examples, but is not limited to the Examples. In the following Examples, unless otherwise specified, "part(s)" and "%" mean "part(s) by weight" and "% by weight", respectively.

—Production of Triisocyanate-Treated Carbon Black T1—

10.0 parts of carbon black (BPL (trade name), manufactured by Cabot), 3.5 parts of methylsilyl triisocyanate (ORGATICS SI-310 (trade name); available from Matsumoto Trading Co., Ltd.), and 100 parts of ethyl acetate are sufficiently mixed in a ball mill under the conditions of a temperature of 90° C., and then an unreacted triisocyanate compound is washed and successively dried, thereby obtaining a triisocyanate-treated carbon black. Since the absorption of the isocyanate group at 2,260 $cm^{-1}$ is observed by IR spectrum, it is confirmed that at least one isocyanate group of the methylsilyl triisocyanate remains as an unbonded isocyanate group.

—Production of Diisocyanate-Treated Carbon Black D1—

10.0 parts of carbon black (BPL (trade name), manufactured by Cabot), 3.5 parts of xylylene diisocyanate (TAKENATE 500 (trade name), manufactured by Mitsui Chemicals), and 100 parts of ethyl acetate are sufficiently mixed in a ball mill under the conditions of a temperature of 90° C., and then an unreacted diisocyanate compound is washed and successively dried, thereby obtaining a diisocyanate-treated carbon black. Since the absorption of the isocyanate group at 2,260 $cm^{-1}$ is observed by IR spectrum, it is confirmed that at least one isocyanate group of the xylylene diisocyanate remains as an unbonded isocyanate group.

—Production of Monoisocyanate-Treated Carbon Black M1—

10.0 parts of carbon black (BPL (trade name), manufactured by Cabot), 3.5 parts of phenyl isocyanate (PHENYL ISOCYANATE (trade name), manufactured by Junsei Chemical Co., Ltd.), and 100 parts of ethyl acetate are sufficiently mixed in a ball mill under the conditions of a temperature of 90° C., and then an unreacted monoisocyanate compound is washed and successively dried, thereby obtaining a monoisocyanate-treated carbon black. The absorption of the isocyanate group at 2,260 $cm^{-1}$ is not observed by IR spectrum.

—Preparation of Black Colorant Dispersion Liquid T1—

Triisocyanate-treated carbon black T1: 60 parts

Nonionic surfactant (NONIPOL 400 (trade name), manufactured by Sanyo Chemical Industries, Ltd.): 5 parts Ion exchange water: 240 parts The above components are mixed and dissolved. The resultant mixture is stirred for 10 minutes using a homogenizer (ULTRA TURRAX T50 (trade name), manufactured by IKA). Thereafter, the thus obtained mixture is dispersed for 10 minutes by a dispersing apparatus ULTIMIZER (trade name). Thus, a black colorant dispersion liquid in which colorant particles (black pigment) having an average particle size of 250 nm are dispersed is obtained.

—Preparation of Black Colorant Dispersion Liquids D1, M1—

Black colorant dispersion liquids D1 and M1 are prepared in substantially the same manner as in the preparation of black colorant dispersion liquid 1 except that triisocyanate-treated carbon black T1 is changed to diisocyanate-treated carbon black D1 and monoisocyanate-treated carbon black M1 respectively in the preparation of black colorant dispersion liquid 1.

—Preparation of Resin Particle Dispersion Liquid 1—

280 parts of styrene, 120 parts of n-butyl acrylate, 8 parts of acrylic acid, 8 parts of dodecanethiol, and 4 parts of carbon tetrabromide are mixed and dissolved. The resultant mixture is allowed to emulsion polymerization in a flask in which 6 parts of a nonionic surfactant (NONIPOL 400 (trade name), manufactured by Sanyo Chemical Industries, Ltd.) and 10 parts of an anionic surfactant (NEOGEN SC (trade name), manufactured by Dai-Ichi Kogyo Seiyaku Co., Ltd.) are dissolved in 550 parts of ion exchange water, and 50 parts of ion exchange water in which 4 parts of ammonium persulfate is dissolved is added thereto while gently mixing for 10 minutes. After substituting the air by nitrogen, the flask is heated in an oil bath until the contents reach 70° C. while stirring the inside of the flask, and the emulsion polymerization is continued for 5 hours. As a result, resin particle dispersion liquid 1 in which resin particles having an average particle size of 150 nm (the resin has Tg of 58° C., and a weight average molecular weight Mw of 33000) are dispersed is obtained. The solid content concentration of this dispersion liquid is 40%.

—Preparation of Release Agent 1—

1,000 parts of Fischer-Tropsch wax (FNP-92 (trade name), manufactured by Nippon Seiro Co., Ltd.) is placed as a raw material in a glass cylindrical reactor, and the temperature is increased to 140° C. while blowing a small amount (3 L/minute) of nitrogen gas thereinto. 48.24 parts (0.33 mol) of a mixed catalyst of boric acid/boric acid anhydride=1.4 (molar ratio) is added, and the content of the reactor is allowed to react at 180° C. for 2.5 hours while blowing the air (21 L/minute) and nitrogen (18 L/minute). After the completion of the reaction, warm water (95° C.) of equivalent amount to those of the reaction mixture is added to the reaction mixture to hydrolyze the reaction mixture, thereby obtaining release agent 1. The hydroxyl value of release agent 1 is 65.0 mgKOH/g and the acid value thereof is 7 mgKOH/g.

(Measurement of Acid Value and Hydroxyl Value)

2 g of the release agent is weighed and dissolved in 150 ml of a solvent to obtain the sample for measurement. Then, the acid value and the hydroxyl value are determined using the obtained sample by the potentiometric titration method of JIS K 0070-1992.

(Preparation of Release Agent 2)

Using 1,000 parts of Fischer-Tropsch wax (FNP-92 (trade name) manufactured by Nippon Seiro Co., Ltd.) as a raw material, release agent 2 is prepared in substantially the same manner as the preparation of release agent 1, except that the amount of the mixed catalyst of boric acid/boric acid anhydride=1.4 (molar ratio) is changed to 0.10 mol. The physical properties of release agent 2 are shown in Tables 1 and 2.

(Preparation of Release Agent 3)

Using 1,000 parts of Fischer-Tropsch wax (FNP-92 (trade name), manufactured by Nippon Seiro Co., Ltd.) as a raw material, release agent 3 is prepared in substantially the same manner as the preparation of release agent 1, except that the reaction time at 180° C. is changed to 0.5 hour. The physical properties of release agent 3 are shown in Table 1.

(Preparation of Release Agent 4)

Using 1,000 parts of Fischer-Tropsch wax (FNP-92 (trade name), manufactured by Nippon Seiro Co., Ltd.) as a raw material, release agent 4 is prepared in substantially the same manner as the preparation of release agent 1, except that the amount of the mixed catalyst of boric acid/boric acid anhydride=1.4 (molar ratio) is changed to 0.10 mol and the reaction time at 180° C. is changed to 0.5 hour. The physical properties of release agent 4 are shown in Table 1.

(Preparation of Release Agent 5)

Using 1,000 parts of Fischer-Tropsch wax (FNP-92 (trade name), manufactured by Nippon Seiro Co., Ltd.) as a raw material, release agent 5 is prepared in substantially the same manner as the preparation of release agent 1, except that the amount of the mixed catalyst of boric acid/boric acid anhydride=1.4 (molar ratio) is changed to 0.10 mol and the reaction time at 180° C. is changed to 2 hours. The physical properties of release agent 5 are shown in Table 1.

(Preparation of Release Agent 6)

Using 1,000 parts of polyethylene wax (PW725 (trade name), manufactured by Baker Petrolite) as a raw material, release agent 6 is prepared in substantially the same manner as the preparation of release agent 1, except that the amount of the mixed catalyst of boric acid/boric acid anhydride=1.4 (molar ratio) is changed to 0.10 mol, as well as the raw material is changed as described above. The reaction time at 180° C. is 2.5 hours. The physical properties of release agent 6 are shown in Table 1.

(Preparation of Release Agent 7)

Using 1,000 parts of microcrystalline wax (HiMic-1090 (trade name), manufactured by Nippon Seiro Co., Ltd.) as a raw material, release agent 7 is prepared in substantially the same manner as the preparation of release agent 1, except that the reaction time at 180° C. is changed to 2.0 hours, as well as the raw material is changed as described above. The amount of the mixed catalyst of boric acid/boric acid anhydride=1.4 (molar ratio) is 0.33 mol. The physical properties of release agent 7 are shown in Table 1.

(Preparation of Release Agent 8)

Using 1,000 parts of paraffin wax (HNP-9 (trade name), manufactured by Nippon Seiro Co., Ltd.) as a raw material, release agent 8 is prepared in the same manner as the preparation of release agent 1, except the reaction time at 180° C. is changed to 2.0 hours, as well as the raw material is changed as described above. The amount of the mixed catalyst of boric acid/boric acid anhydride=1.4 (molar ratio) is 48.24 parts (0.33 mol). The physical properties of release agent 8 are shown in Table 1.

(Preparation of Release Agent 9)

Using 1,000 parts of paraffin wax (HNP-9 (trade name), manufactured by Nippon Seiro Co., Ltd.) as a raw material, release agent 9 is prepared in substantially the same manner as the preparation of release agent 1, except that the reaction time at 180° C. is changed to 0.5 hour, as well as the raw material is changed as described above. The amount of the mixed catalyst of boric acid/boric acid anhydride=1.4 (molar ratio) is 48.24 parts (0.33 mol). The physical properties of release agent 9 are shown in Table 2.

(Preparation of Release Agent 10)

Using 1,000 parts of paraffin wax (HNP-9 (trade name), manufactured by Nippon Seiro Co., Ltd.) as a raw material, release agent 10 is prepared in substantially the same manner as the preparation of release agent 1, except that the amount of the mixed catalyst of boric acid/boric acid anhydride=1.4 (molar ratio) is changed to 0.10 mol and the reaction time at 180° C. is changed to 0.5 hour, as well as the raw material is changed as described above. The physical properties of release agent 10 are shown in Table 2.

(Preparation of Release Agent Dispersion Liquid 1)

Release agent 1: 100 parts

Cationic surfactant (SANISOL B50 (trade name), manufactured by Kao Corporation): 5 parts Ion exchange water: 240 parts The above components are dispersed for 10 minutes using a homogenizer (ULTRA TURRAX T50 (trade name), manufactured by IKA) in a round-shaped stainless steel flask and, then, dispersed by a pressure discharge type homogenizer, thereby preparing a release agent dispersion liquid in which release agent particles having an average particle size of 350 nm are dispersed.

(Preparation of Release Agent Dispersion Liquids 2 to 10)

Release agent dispersion liquids 2 to 10 are obtained in substantially the same manner as the preparation of release agent dispersion liquid 1, except that release agents 2 to 10 are used respectively in place of release agent 1.

Example 1

Production of Toner Particles (1)

Resin particle dispersion liquid 1: 234 parts

Black colorant dispersion liquid T1: 30 parts

Release agent dispersion liquid 1: 40 parts

Polyaluminum chloride (PAC100W (trade name), manufactured by Asada Chemical Co., Ltd.): 1.8 parts Ion exchange water: 600 parts The above component are mixed and dispersed using a homogenizer (ULTRA TURRAX T50 (trade name), manufactured by IKA) in a round-shaped stainless steel flask. Thereafter, while stirring the inside of the flask, the flask is heated to 52° C. in an oil bath for heating. After holding the flask at 52° C. for 120 minutes, it is confirmed that aggregated particles having a volume average particle size D50 of 4.8 μm are generated. Then, 32 parts of a resin particle dispersion liquid is further added to the dispersion liquid containing the aggregated particles, and the temperature of the oil bath for heating is increased to 53° C. and held at 53° C. for 30 minutes. To the dispersion liquid containing the aggregated particles, 1N sodium hydroxide is added, and the pH of the system is adjusted to 5.0. Then, the stainless steel flask is sealed. Thereafter, the stainless steel flask is heated to 95° C. while continuing the stirring using a magnetic seal, and held at 5.0 for 2 hours at pH of 5.0. After cooling, the toner mother particles are separated by filtration, washed 4 times with ion exchange water, and then freeze dried, thereby obtaining toner particles (1). The volume average particle size D50v of toner particles (1) is 5.5 μm and the shape factor is 135.

—Production of Toner (1)—

With 100 parts of toner particles (1), 1.3 parts of silicon oil-treated silicon oxide particles (RY50 (trade name), manufactured by Japan Aerozil Co. Ltd.) having an average particle size of 40 nm are mixed in a sample mill, thereby obtaining toner (1).

—Production of Carrier—

Toluene: 15 parts

Methylmethacrylate-perfluorooctyl methacrylate copolymer (Mw: 50,000, Copolymerization ratio of methylmethacrylate-perfluorooctyl methacrylate: 75/25): 1.5 parts Melamine beads (Volume average particle size: 0.3 μm): 0.4 parts The above components are dispersed for 10 minutes in an ultrasonic dispersion device while stirring, thereby obtaining a coated layer forming liquid. The coated layer forming liquid and 100 parts of ferrite having an average particle size of 50 μm are placed in a vacuum degassing type kneader, and stirred at a temperature of 60° C. for 10 minutes. Then, the pressure is reduced, toluene is distilled off, and thus a resin coated layer is formed on the surface of the ferrite, thereby obtaining a carrier.

—Production of Developer (1)—

8 parts of toner (1) and 100 parts of the carrier are stirred at 40 rpm for 20 minutes using a V-blender, and sieved by a sieve having an opening of 212 μm, thereby obtaining developer (1).

Evaluation Items (1) Aggregation Properties (Aggregation Properties by 2 g Method)

The aggregation properties of toner (1) are confirmed by the following aggregation degree test.

2 g of a toner for electrostatic charge image development is weighed, and stored under the atmosphere of a temperature of 40° C. and a humidity of 80% for 24 hours, the stored toner is put on a sieve having an opening of 15 μm, fixed vibration (number of vibration of 3600 VPM, for 3 minutes at 60 Hz) is applied, and the amount of toner remaining on the sieve is weighed. The aggregation degree is calculated according to Equation 1, and the aggregation properties are evaluated.

$$\text{Aggregation degree (\%)} = (\text{Toner remaining on sieve (g)}/2\ \text{(g)} \times 100 \qquad \text{Equation 1}$$

(2) Image Defect

The number of spots (color points) due to a toner aggregate when an A3 size blank paper is printed out and the number of spots when the number of prints reaches 100 are counted, and then the image defect is evaluated. The toner stored beforehand in a chamber of a temperature of 40° C. and a humidity of 80% for 24 hours is used.

The smaller the number of the spots, the better the evaluation results. The tolerable number of the spots is 9 or lower.

Examples 2 to 8

Toners (2) to (8) and developers (2) to (8) are produced in substantially the same manner as in Example 1, except that release agent dispersion liquid 1 used for the production of toner particles (1) in Example 1 is changed to release agent dispersion liquids 2 to 8 respectively, and are evaluated in substantially the same manner as in Example 1. The results are shown in Table 3.

Examples 9 and 10

Toners (9) and (10) and developers (9) and (10) are produced in substantially the same manner as in Example 1, except that black colorant dispersion liquid T1 used for the production of the toner particles (1) is changed to black colorant dispersion liquid D1 and release agent dispersion liquid 1 used for the production of toner particles (1) in Example 1 is changed to release agent dispersion liquids 1 and 2 respectively, and are evaluated in substantially the same manner as in Example 1. The results are shown in Table 3.

Comparative Example 1

Toner (11) and developer (11) are produced in substantially the same manner as in Example 1, except that black colorant dispersion liquid T1 used for the production of toner particles (1) in Example 1 is changed to black colorant dispersion liquid M1, and are evaluated in substantially the same manner as in Example 1. The results are shown in Table 3.

Comparative Example 2

Toner (12) an developer (12) are produced in substantially the same manner as in Example 2, except that black colorant dispersion liquid T1 used for the production of the toner particles (2) in Example 2 is changed to black colorant dispersion liquid M1, and are evaluated in the same manner as in Example 1. The results are shown in Table 3.

Comparative Examples 3 and 4

Toners (13) and (14) and developers (13) and (14) are produced in substantially the same manner as in Example 1, except that release agent dispersion liquid 1 used for the production of the toner particles (1) in Example 1 is changed to the release agent dispersion liquids 9 and 10 respectively, and are evaluated in substantially the same manner as in Example 1. The results are shown in Table 3.

TABLE 1

| | Black colorant (treated carbon black) | | Isocyanate | Release agent | | | | | |
|---|---|---|---|---|---|---|---|---|---|
| | Dispersion liquid No. | Black colorant | compound to be added | Dispersion liquid No. | Release agent No. | Type | Functional group | Acid value | Hydroxyl value |
| Ex. 1 | T1 | Carbon black (BPL) | Methylsilyl triisocyanate (ORGATICS SI-310) | 1 | 1 | Alcohol-modified Fischer-Tropsch wax | OH group | 3 | 38 |
| Ex. 2 | | | | 2 | 2 | Alcohol-modified Fischer-Tropsch wax | —COOH group | 28 | 4 |
| Ex. 3 | | | | 3 | 3 | Alcohol-modified Fischer-Tropsch wax | —OH group | 0 | 5 |
| Ex. 4 | | | | 4 | 4 | Alcohol-modified Fischer-Tropsch wax | —COOH group | 5 | 0 |
| Ex. 5 | | | | 5 | 5 | Alcohol-modified Fischer-Tropsch wax | —COOH group, —OH group | 43 | 38 |
| Ex. 6 | | | | 6 | 6 | Alcohol-modified polyethylene wax | —COOH group, —OH group | 94 | 51 |
| Ex. 7 | | | | 7 | 7 | Alcohol-modified microcrystalline wax | —COOH group, —OH group | 40 | 97 |
| Ex. 8 | | | | 8 | 8 | Paraffin wax | Ester group | 13 | 20 |
| Ex. 9 | D1 | | Xylylene diisocyanate (TAKENATE 500) | 1 | 1 | Alcohol-modified Fischer-Tropsch wax | OH group | 3 | 38 |
| Ex. 10 | | | | 2 | 2 | Alcohol-modified Fischer-Tropsch wax | —COOH group | 28 | 4 |

ORGATICS SI-310; available from Matsumoto Trading Co., Ltd.
BPL: carbon black, manufactured by Cabot

TABLE 2

| | Black colorant (treated carbon black) | | Isocyanate | Release agent | | | | | |
|---|---|---|---|---|---|---|---|---|---|
| | Dispersion liquid No. | Black colorant | compound to be added | Dispersion liquid No. | Release agent No. | Type | Functional group | Acid value | Hydroxyl value |
| Comp. Ex. 1 | M1 | Carbon black (BPL) | Phenyl isocyanate | 1 | 1 | Alcohol-modified Fischer-Tropsch wax | OH group | 3 | 38 |
| Comp. Ex. 2 | | | | 2 | 2 | Alcohol-modified Fischer-Tropsch wax | —COOH group | 28 | 4 |
| Comp. Ex. 3 | T1 | | Methylsilyl triisocyanate (ORGATICS SI-310) | 9 | 9 | Paraffin wax | OH group | 0 | 3 |
| Comp. Ex. 4 | | | | 10 | 10 | Paraffin wax | —COOH group | 3 | 0 |

ORGATICS SI-310; available from Matsumoto Trading Co., Ltd
BPL: carbon black, manufactured by Cabot

TABLE 3

| | 40° C. aggregation properties | Image defect |
|---|---|---|
| Ex. 1 | 15 | 2 |
| Ex. 2 | 17 | 1 |
| Ex. 3 | 21 | 4 |
| Ex. 4 | 20 | 4 |
| Ex. 5 | 6 | 0 |
| Ex. 6 | 11 | 2 |
| Ex. 7 | 12 | 3 |
| Ex. 8 | 15 | 3 |
| Ex. 9 | 23 | 2 |
| Ex. 10 | 25 | 2 |
| Comp. Ex. 1 | 87 | 11 |
| Comp. Ex. 2 | 77 | 10 |
| Comp. Ex. 3 | 75 | 10 |
| Comp. Ex. 4 | 85 | 13 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated.

What is claimed is:

1. A toner comprising:

a binder resin;

carbon black whose surface is treated with a diisocyanate compound or a triisocyanate compound including a plurality of isocyanate groups, a part of the plurality of isocyanate groups being unbonded; and a release agent having an acid value of about 5 mgKOH/g or higher and/or a hydroxyl value of about 5 mgKOH/g or higher, wherein the diisocyanate compound or the triisocyanate compound comprises at least one member selected from the group consisting of 2,4-tolylene diisocyanate, 2,6-tolylene diisocyanate, diphenyl methane diisocyanate, polymeric diphenylmethane diisocyanate, hydrogenated diphenylmethane diisocyanate, 1,5-naphthalene diisocyanate, 3,3'-dimethyldiphenyl-4,4'-diisocyanate, hexamethylene diisocyanate, isophorone diisocyanate, m-phenylene diisocyanate, p-phenylene diisocyanate, trans cyclohexane 1,4-diisocyanate, diphenyl ether diisocyanate, xylylene diisocyanate, hydrogenated xylylene diisocyanate, 2,6-diisocyanatocaproic acid, tetramethyl-m-xylene diisocyanate, tetramethyl-p-xylene diisocyanate, trimethylhexamethylene diisocyanate, triphenylmethane triisocyanate, tris(isocyanatophenyl)thiophosphate, isocyanatoalkyl-2,6-diisocyanato capronate, 1,6,11-undecane triisocyanate, 1,8-diisocyanato-4-isocyanatomethyloctane, 1,3,6-hexamethylene triisocyanate, bicycloheptane triisocyanate, naphthalene-1,4-diisocyanate, diphenyl methane-4,4-diisocyanate, 3,3'-dimethoxy-4,4-biphenyl diisocyanate, 3,3'-dimethylphenylmethane-4,4'-diisocyanate, xylylene-1,4-diisocyanate, 4,4'-diphenylpropanediisocyanate, trimethylenediisocyanate, hexamethylenediisocyanate, propylene-1,2-diisocyanate, butylene-1,2-diisocyanate, cyclohexylene-1,2-diisocyanate, cyclohexylene-1,4-diisocyanate, 4,4',4"-triphenylmethanetriisocyanate, and toluene-2,4,6-triisocyanate.

2. The toner according to claim 1, wherein the carbon black has a dibutyl phthalate (DBP) absorption amount of from about 50 ml/100 g to about 250 ml/100 g.

3. The toner according to claim 1, wherein the content of the carbon black in the toner is from about 0.1% by weight to about 20% by weight relative to the toner.

4. The toner according to claim 1, wherein the release agent includes at least one functional group that interacts with the isocyanate groups.

5. The toner according to claim 4, wherein the at least one functional group that interacts with the isocyanate groups comprises an alcohol group or an ester group.

6. The toner according to claim 1, wherein the release agent includes at least one selected from the group consisting of an alcohol-modified Fischer-Tropsch wax and an ester wax.

7. The toner according to claim 1, wherein the release agent is contained in the toner in an amount of from about 2% by weight to about 20% by weight relative to the toner.

8. A developer comprising a toner according to claim 1 and a carrier.

9. The developer according to claim 8, wherein the carrier is coated with a resin including a copolymer of methyl methacrylate and perfluorooctyl methacrylate.

10. The developer according to claim 9, wherein the resin further includes melamine beads.

11. A toner cartridge, containing at least the toner according to claim 1.

12. A process cartridge comprising:

a developing unit that develops an electrostatic latent image with the developer according to claim 8 to form a toner image; and at least one selected from the group consisting of an electrostatic latent image holding member, a charging unit that charges a surface of the electrostatic latent image holding member, an electrostatic latent image forming unit that forms an electrostatic latent image on the surface of the electrostatic latent image holding member, and a cleaning unit that removes toner remaining on the surface of the electrostatic latent image holding member.

13. An image forming apparatus comprising:

an electrostatic latent image holding member;

a charging unit that charges a surface of the electrostatic latent image holding member;

an electrostatic latent image forming unit that forms an electrostatic latent image on the surface of the electrostatic latent image holding member;

a developing unit that develops the electrostatic latent image with the developer according to claim 8 to form a toner image;

a transfer unit that transfers the toner image to a recording medium; and a fixing unit that fixes the toner image to the recording medium.

* * * * *